US007956752B2

(12) United States Patent
Henderson

(10) Patent No.: US 7,956,752 B2
(45) Date of Patent: Jun. 7, 2011

(54) TRANSPONDER BOLT SEAL AND A HOUSING FOR A TRANSPONDER

(76) Inventor: Matthew Henderson, Haberfield (AU)

( * ) Notice: Subject to any disclaimer, the term of this patent is extended or adjusted under 35 U.S.C. 154(b) by 343 days.

(21) Appl. No.: 11/813,806

(22) PCT Filed: Jan. 13, 2006

(86) PCT No.: PCT/AU2006/000038

§ 371 (c)(1),
(2), (4) Date: Jan. 30, 2008

(87) PCT Pub. No.: WO2006/074518

PCT Pub. Date: Jul. 20, 2006

(65) Prior Publication Data

US 2009/0121877 A1 May 14, 2009

(30) Foreign Application Priority Data

Jan. 14, 2005 (AU) ..... 2005900146
Mar. 31, 2005 (AU) ..... 2005901557
Sep. 23, 2005 (AU) ..... 2005905259

(51) Int. Cl.
*G08B 13/14* (2006.01)

(52) U.S. Cl. ..... 340/572.8; 340/572.7; 343/878

(58) Field of Classification Search ..... 340/572.1, 340/572.7, 572.8, 542, 10.1; 343/878
See application file for complete search history.

(56) References Cited

U.S. PATENT DOCUMENTS 5,097,253 A 3/1992 Eschbach et al. ..... 340/545
5,406,263 A 4/1995 Tuttle ..... 340/540
5,507,410 A 4/1996 Clark et al. ..... 221/171
5,536,471 A 7/1996 Clark et al. ..... 427/63
5,552,759 A 9/1996 Stoyka ..... 340/426
5,627,522 A 5/1997 Walker et al. ..... 340/618
5,646,592 A 7/1997 Tuttle ..... 340/572
5,762,878 A 6/1998 Clark et al. ..... 422/102
5,914,671 A 6/1999 Tuttle ..... 340/825.54
5,960,160 A 9/1999 Clark et al. ..... 392/481
6,061,589 A 5/2000 Bridges et al. ..... 600/430
6,069,563 A 5/2000 Kadner et al. ..... 340/571
6,121,878 A * 9/2000 Brady et al. ..... 340/572.1
6,127,917 A 10/2000 Tuttle ..... 340/10.1
6,219,952 B1 4/2001 Mossberg et al. ..... 42/70.01

(Continued)

FOREIGN PATENT DOCUMENTS

CA 242937 10/2002

(Continued)

OTHER PUBLICATIONS

Chinese First Office Action, dated Feb. 27, 2009 (Original and English Translation), 18 pages.

(Continued)

*Primary Examiner* — Thomas J Mullen
(74) *Attorney, Agent, or Firm* — Woodcock Washburn LLP

(57) ABSTRACT

An electronic seal (100), housing (1) for a transponder (200), which may form part of an electronic seal (100) and a transponder device is provided. The electronic seal (100) has a sealing mechanism (5). A transponder receptacle (50), and an actuator (4) are provided by or with the housing (1). The actuator (4) is actuated upon engagement of the sealing mechanism (5) to render the transponder (200) operable. The transponder receptacle (50) may hold the transponder (200) so as to extend into three planes.

36 Claims, 9 Drawing Sheets

U.S. PATENT DOCUMENTS

| | | | | |
|---|---|---|---|---|
| 6,226,619 | B1 | 5/2001 | Halperin et al. | 705/1 |
| 6,265,973 | B1 | 7/2001 | Brammall et al. | 340/568.1 |
| 6,282,829 | B1 | 9/2001 | Mossberg et al. | 42/70.11 |
| 6,343,429 | B1 | 2/2002 | Mossberg et al. | 42/70.01 |
| 6,366,260 | B1 | 4/2002 | Carrender | 343/866 |
| 6,407,666 | B1 | 6/2002 | Debrody et al. | 340/568.4 |
| 6,412,207 | B1 | 7/2002 | Crye et al. | 42/70.06 |
| 6,420,971 | B1 * | 7/2002 | Leck et al. | 340/571 |
| 6,421,013 | B1 | 7/2002 | Chung | 343/700 MS |
| 6,509,829 | B1 | 1/2003 | Tuttle | 340/10.1 |
| 6,554,188 | B1 | 4/2003 | Johnson et al. | 235/385 |
| 6,603,400 | B1 | 8/2003 | Shoobridge | 340/572.1 |
| 6,644,771 | B1 | 11/2003 | Silverbrook | 347/19 |
| 6,699,188 | B2 | 3/2004 | Wessel | 600/300 |
| 6,717,154 | B2 | 4/2004 | Black et al. | 250/393 |
| 6,747,558 | B1 | 6/2004 | Thorne et al. | 340/551 |
| 6,750,771 | B1 | 6/2004 | Brand | 340/575.7 |
| 6,753,775 | B2 * | 6/2004 | Auerbach et al. | 340/539.22 |
| 6,753,782 | B2 | 6/2004 | Power | 340/573.4 |
| 6,794,000 | B2 | 9/2004 | Adams et al. | 428/40.1 |
| 6,819,244 | B2 | 11/2004 | Dukler et al. | 340/572.1 |
| 6,879,257 | B2 | 4/2005 | Hisano et al. | 340/568.2 |
| 6,883,710 | B2 | 4/2005 | Chung | 235/385 |
| 6,888,502 | B2 | 5/2005 | Beigel et al. | 343/700 MS |
| 6,888,509 | B2 | 5/2005 | Atherton | 343/718 |
| 6,891,474 | B1 | 5/2005 | Fletcher | 340/572.1 |
| 6,909,366 | B1 | 6/2005 | Marsh et al. | 340/505 |
| 6,919,803 | B2 | 7/2005 | Breed | 340/539.14 |
| 2002/0036237 | A1 | 3/2002 | Atherton et al. | 235/492 |
| 2002/0060630 | A1 | 5/2002 | Power | 340/573.1 |
| 2002/0067264 | A1 | 6/2002 | Soehnlen | 340/572.1 |
| 2002/0080032 | A1 | 6/2002 | Smith et al. | 340/572.1 |
| 2002/0135481 | A1 | 9/2002 | Conwell et al. | 340/572.1 |
| 2002/0140557 | A1 | 10/2002 | Dukler et al. | 340/572.1 |
| 2002/0183882 | A1 | 12/2002 | Dearing et al. | 700/115 |
| 2003/0004005 | A1 | 1/2003 | Ainsworth et al. | 473/151 |
| 2003/0031819 | A1 | 2/2003 | Adams et al. | 428/40.1 |
| 2003/0036425 | A1 | 2/2003 | Kaminkow et al. | 463/25 |
| 2003/0050537 | A1 | 3/2003 | Wessel | 600/300 |
| 2003/0075608 | A1 | 4/2003 | Atherton | 235/492 |
| 2003/0132893 | A1 | 7/2003 | Forster et al. | 343/895 |
| 2003/0169207 | A1 | 9/2003 | Beigel | 343/718 |
| 2003/0189491 | A1 | 10/2003 | Ng | 340/572.9 |
| 2003/0204739 | A1 | 10/2003 | Ng et al. | 713/194 |
| 2004/0003683 | A1 | 1/2004 | Rudduck | 81/52 |
| 2004/0066296 | A1 | 4/2004 | Atherton | 340/572.1 |
| 2004/0119593 | A1 | 6/2004 | Kuhns | 340/572.7 |
| 2004/0215350 | A1 | 10/2004 | Roesner | 700/1 |
| 2005/0012616 | A1 | 1/2005 | Forster et al. | 340/572.7 |
| 2005/0030178 | A1 | 2/2005 | Meijer | 340/542 |
| 2005/0051624 | A1 | 3/2005 | Kipp et al. | 235/385 |
| 2005/0151699 | A1 | 7/2005 | Eastin | 343/867 |
| 2005/0155213 | A1 | 7/2005 | Eastin | 29/593 |
| 2005/0156806 | A1 | 7/2005 | Ohta et al. | 343/834 |
| 2005/0162277 | A1 | 7/2005 | Teplitxky et al. | 340/572.8 |
| 2005/0179548 | A1 | 8/2005 | Kittel et al. | 340/568.2 |
| 2005/0194437 | A1 | 9/2005 | Dearing et al. | 235/382 |

FOREIGN PATENT DOCUMENTS

| | | | |
|---|---|---|---|
| EP | 029221 | A1 | 8/1998 |
| EP | 0863489 | B1 | 3/2003 |
| EP | 1445406 | A3 | 8/2004 |
| EP | 1487126 | A1 | 12/2004 |
| EP | 0831197 | B1 | 3/2005 |
| EP | 1512944 | A3 | 3/2005 |
| EP | 1559278 | A2 | 8/2005 |
| EP | 1063627 | | 12/2005 |
| JP | 2003056224 | | 2/2003 |
| WO | 9936297 | A1 | 7/1999 |
| WO | 9945512 | A1 | 9/1999 |
| WO | 0203994 | A1 | 4/2000 |
| WO | 0049360 | A2 | 8/2000 |
| WO | 0063052 | A1 | 10/2000 |
| WO | 0167413 | A1 | 9/2001 |
| WO | 0204174 | A1 | 1/2002 |
| WO | 0211094 | A1 | 2/2002 |
| WO | 02077939 | A1 | 10/2002 |
| WO | 02095655 | A2 | 11/2002 |
| WO | 03002209 | A3 | 1/2003 |
| WO | 03013678 | A1 | 2/2003 |
| WO | 03073201 | A3 | 9/2003 |
| WO | 03077361 | A1 | 9/2003 |
| WO | 2004013820 | A3 | 2/2004 |
| WO | 2004021299 | A1 | 3/2004 |
| WO | 2004052742 | A1 | 6/2004 |
| WO | 2004061762 | A1 | 7/2004 |
| WO | 2004059563 | B1 | 9/2004 |
| WO | 2004088571 | A3 | 10/2004 |
| WO | 2004101370 | A3 | 11/2004 |
| WO | 2004102327 | A3 | 11/2004 |
| WO | 2004102330 | A3 | 11/2004 |
| WO | 2005022443 | A3 | 3/2005 |
| WO | 2005074681 | A3 | 8/2005 |
| WO | 2005/079223 | A2 | 9/2005 |
| WO | 2006004484 | | 1/2006 |

OTHER PUBLICATIONS

Singapore First Office Action, dated Oct. 30, 2008, 6 pages.

* cited by examiner

TRANSPONDER BOLT SEAL AND A HOUSING FOR A TRANSPONDER

FIELD OF THE INVENTION

This invention relates to electronic security seals. It also relates to housings for transponders. In particular, but not exclusively, the present invention relates to electronic security seals for use on shipping containers.

BACKGROUND OF THE INVENTION

The security of containers has become an important issue in today's security-conscious environment. This is particularly apparent in the shipping of containers across borders. The locking of loaded containers to prevent unauthorised access after the containers have been loaded and before the containers reach their destination is now seen as an important, if not mandatory security precaution.

Of course, a lock on a container may be removed and then replaced. Therefore, it is important that tampering with a lock is able to be detected. To assist with the identification of tampering with locks, electronic seals have been utilised.

One form of electronic seal that has been used in the past is an electronic tagging device that wirelessly transmits information to an interrogator. This information identifies whether the lock has been tampered with.

U.S. Pat. No. 6,265,973 (Brammall et al.) describes an electronic security seal. A conductor along the bolt shank is connected to a circuit and provides a tamper evident signal to the circuit when the bolt is severed. The circuit senses removal of the bolt or severed bolt condition and generates a "tamper" signal, which is transmitted to a local receiver/reader.

U.S. Pat. No. 6,747,558 (Thorne et al.) describes a method and apparatus for providing container security with a tag. A device includes a bolt, which extends through openings in a latch mechanism on the container. The bolt also passes through spaced coils of the seal device. The sealed device uses one coil to generate a magnetic field, while monitoring the corresponding magnetic field induced in the other coil. Tampering with the bolt affects the magnetic field, which in turn permits the seal device to detect the tampering. The seal device periodically transmits wireless signals, which can be remotely received for the purpose of tracking the container and monitoring the integrity of the seal.

A major disadvantage of providing sophisticated electronic security seals is the increased cost involved in shipping containers. Even if the devices are made to be reusable, there is the associated cost, inconvenience and possible additional security issues related to the reuse of electronic seals. In addition, electronic seals that actively transmit signals may be subject to stringent regulations regarding the maximum power of transmission and the frequency bands in which transmissions may be made. These regulations may change from jurisdiction to jurisdiction and over time. There is also the problem of passive transponders interfering with the signals from other passive transponders when interrogated. This problem remains even in applications where evidence of tampering with a lock is not required.

Apart from the sealing function of electronic seals, there are many other applications where removal or tampering with a value item needs to be detected.

It is therefore an object the present invention to overcome or ameliorate problems with electronic seals and/or transponder devices at present, or at least to provide the public with a useful alternative.

Any reference in this specification to the prior art does not constitute, nor should it be considered, an admission that such prior art was widely known or forms part of the common general knowledge in Australia, or in any other jurisdiction, before the priority date of any of the appended claims.

SUMMARY OF THE INVENTION

According to a first aspect of the present invention, there is provided an electronic seal comprising a sealing mechanism that seals a value item, a transponder receptacle, and an actuator for a transponder held in the transponder receptacle that is actuated upon engagement of the sealing mechanism, wherein the electronic seal maintains a transponder held in the transponder receptacle in an inoperable state until and only until the actuator is actuated.

Preferably, the sealing mechanism comprises a receptacle to receive a locking member and wherein insertion of the locking member in the receptacle causes the actuator to actuate.

Preferably, the electronic seal comprises an electrically conductive object and wherein actuation of the actuator results in movement of the electrically conductive object away from a position where it can contact a transponder held in the transponder receptacle.

Preferably, the transponder receptacle comprises at least a portion that is shaped and dimensioned to hold at least one part of at least one antenna of a transponder in a curved shape. The curved shape may have a convex side facing away from the sealing mechanism and a concave side facing towards the sealing mechanism.

Preferably, the transponder receptacle is formed within a cover for the sealing mechanism. The electronic seal may be adapted for use to seal a shipping container having at least one door, wherein the sealing mechanism is adapted to seal the at least one door and the cover maintains the transponder in an orientation outwards of the at least one door.

According to a second aspect of the present invention, there is provided a transponder housing for a transponder having a flexible antenna structure, the housing including a transponder receptacle that extends into three planes so as to enable a transponder located in the transponder receptacle to transmit a signal over a wider range of angles than if the transponder receptacle were planar.

Preferably, the transponder housing forms part of an electronic seal comprising a sealing mechanism that seals a value item, and a cover one of formed integrally with and secured to the sealing mechanism, wherein the cover inhibits access to the sealing mechanism without first either removing the cover from the sealing mechanism or damaging at least one of the cover and any transponder held in the receptacle.

Preferably, the transponder receptacle has a non-linear shape along a first axis and a substantially planar shape along a second axis that is transverse to the first axis. The non-linear shape may be a curve.

Alternatively, the transponder receptacle has a non-linear shape along two orthogonal axes. The non-linear shape may be a curved shape.

Preferably, the housing is attachable to a separate object and is shaped and dimensioned to maintain the transponder in a required orientation after it has been attached to the object.

Preferably, the cover is removably engaged with the sealing mechanism by an engagement mechanism and wherein release of the engagement mechanism causes a transponder held in said transponder receptacle to be one of detectably modified and damaged.

Preferably, the transponder housing comprises a transponder in the transponder receptacle. The housing may be constructed so that removal of the transponder from the transponder receptacle is prevented without visibly damaging the housing. At least part of the housing may be formed by a material that was moulded about the transponder.

According to a third aspect of the present invention, there is provided an electronic seal comprising a sealing mechanism that seals a value item, a transponder receptacle, and a removable cover that inhibits access to the sealing mechanism, wherein removal of the removable cover causes a transponder held in the transponder receptacle to be one of detectably modified and damaged.

Preferably, the removable cover is removed by actuating an actuator, wherein actuation of the actuator causes a transponder held in the transponder receptacle to be one of detectably modified and damaged.

Preferably, removal of the cover for the sealing mechanism causes the seal to physically damage a transponder held in the transponder receptacle.

Preferably, the seal is constructed so that after a transponder has been received by the transponder receptacle, removal of a transponder from the transponder receptacle is prevented without visibly damaging the seal.

Preferably, the electronic seal comprises a transponder in the transponder receptacle. At least part of the seal may be formed by a material that was moulded about the transponder. The cover may include a first portion that is a clamp to hold the transponder in place and a second portion that is moulded over the clamp.

According to a fourth aspect of the present invention, there is provided an electronic seal comprising a sealing mechanism that seals a value item, a removable cover for the sealing mechanism, the removable cover having therein a transponder receptacle and being one of formed integrally with and secured to the sealing mechanism, and an actuator that is actuated upon engagement of the sealing mechanism, wherein the electronic seal maintains a transponder held in the transponder receptacle in an inoperable state until and only until the actuator is actuated, and wherein the transponder receptacle is adapted to cause a transponder located in the receptacle to have a shape that extends into three planes and wherein removal of the removable cover causes a transponder held in the transponder receptacle to be one of detectably modified and damaged.

Preferably, removal of the removable cover involves actuating a further actuator and wherein the actuation of the further actuator causes a transponder held in the transponder receptacle to be one of detectably modified and damaged.

Preferably, the electronic seal comprises a transponder in the transponder receptacle, the removable cover formed so that removal of the transponder from the transponder receptacle is prevented without damaging the cover.

According to a fifth aspect of the present invention, there is provided a method of manufacturing an electronic seal, the method comprising forming a seal mechanism for a value item and forming a cover for the seal mechanism, the cover for the seal mechanism moulded about a transponder to enclose the transponder, the cover formed in a shape so that disengagement of the seal from a value item can only be achieved by one of damaging and modifying the transponder.

Preferably, the transponder is a passive transponder and the cover is formed in a shape so that disengagement of the seal from a value item can only be achieved by damaging an antenna of the transponder.

Preferably, the method further comprises forming the seal mechanism and cover as separate removably engageable components and forming an actuator, wherein actuation of the actuator both allows disengagement of the seal mechanism and cover after they have been engaged and causes the transponder to be one of damaged and modified.

According to a sixth aspect of the present invention, there is provided an electronic device for monitoring a value item comprising a transponder, and an actuator for the transponder that is actuated upon tampering with the value item, wherein the electronic device maintains a transponder held in the transponder receptacle in an inoperable state until and only until the actuator is actuated or vice-versa.

Preferably, the actuator comprises a receptacle to receive a locking member and wherein one of removal and insertion of the locking member in the receptacle causes the actuator to actuate.

Preferably, the electronic device comprises an electrically conductive object and wherein actuation of the actuator results in movement of the electrically conductive object into or out of contact with the transponder to place the transponder in an inoperable and operable state respectively.

Preferably, the transponder receptacle comprises at least a portion that is shaped and dimensioned to hold at least one part of at least one antenna of a transponder in a curved shape.

According to a seventh aspect of the present invention, there is provided an electronic seal for a shipping container, the electronic seal comprising a sealing mechanism that seals the shipping container through the use of a locking member, a cover for the sealing mechanism that is one of formed integrally with and secured to the sealing mechanism and a transponder receptacle that is located spaced apart from the locking member when the locking member is used with the sealing mechanism.

Preferably, the transponder receptacle is adapted to cause a transponder located in the receptacle to have a shape that extends into three planes.

Preferably, the cover forms a partial enclosure of the sealing mechanism.

Preferably, the transponder receptacle is formed within said cover.

According to an eighth aspect of the present invention, there is provided a transponder device comprising a transponder and an actuator that when actuated moves a conductive object from and to a predetermined position, wherein when the conductive object is in the predetermined position the transponder is maintained in an inoperable state and changes to an operable state when the conductive object is moved from the predetermined position.

Preferably, the transponder is housed within a cover and the actuator is adapted to be moved when the cover is engaged with an object in a predetermined manner.

The electronic seal, transponder housing or transponder device preferably comprises a cover and the cover and sealing mechanism may be engaged by a frangible link and wherein breakage of the frangible link causes the transponder to become inoperable.

According to a ninth aspect of the present invention, there is provided a method of forming a transponder device, the method comprising forming on a flexible substrate a planar antenna structure for a transponder and forming a housing for the antenna structure, the housing shaping the transponder into a required three dimensional shape to achieve required transmission characteristics for the antenna structure.

Preferably, the method further comprises forming the housing so as to be secured to or securable to an object and forming the housing in a shape that is adapted to hold the transponder in a required orientation relative to said object.

Further aspects of the present invention will become apparent from the following description, given by way of example only and with reference to the accompanying drawings.

DETAILED DESCRIPTION OF THE EMBODIMENTS

The present invention relates to an electronic seal. The electronic seal may be used to seal a value item (for example a door indicated by 300 in FIG. 1), which may be any item that requires sealing, regardless of its monetary value. By way of example only, the electronic seal may be used to seal containers, a door to a room or compartment, or a control panel or button. The shape of the electronic seal and the mechanism by which the value item is sealed will vary depending on the application.

The electronic seal may have particular application to the sealing of shipping containers and may provide advantages and functionally that make it particularly suited to this application. The following description is therefore provided with specific reference to an electronic seal for a shipping container. Variations and/or modifications to the electronic seal of the present invention to make the electronic seal suitable or more suited to other applications will be apparent to those skilled in the relevant arts, and such variations and/or modifications are intended to be within the scope of the present invention.

Figure 1:
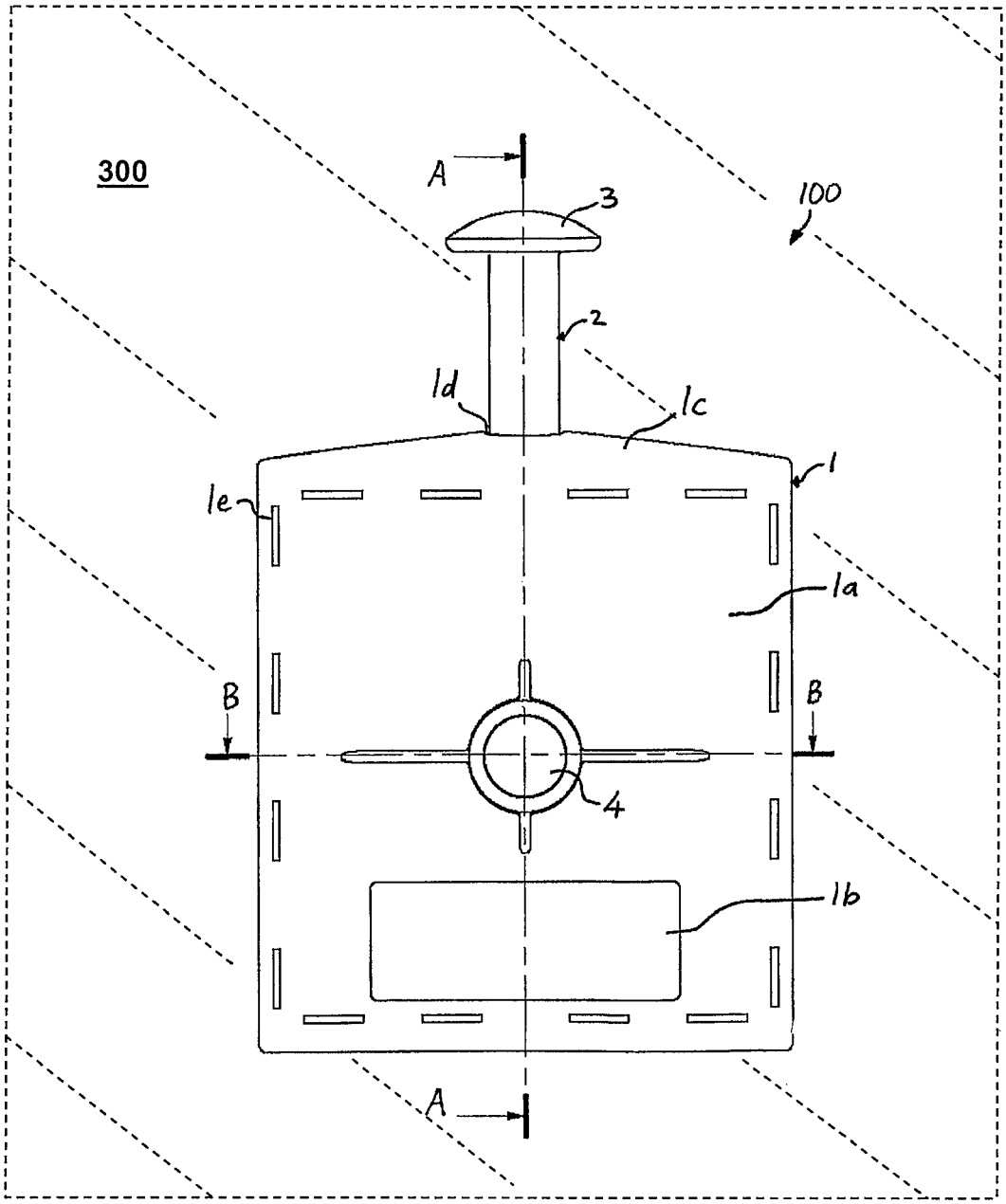
FIG. 1: shows a front elevation of an electronic seal in an unlocked position, according to one embodiment of the present invention.

FIG. 1 of the accompanying drawings shows a front elevation of an electronic seal according to an embodiment of the present invention, which is generally referenced by arrow 100 and which is placed on a door 300. The seal 100 includes a cover 1, a bolt 2 having a head 3, and a button 4. The cover 1 has a curved front face 1*a* and may optionally include a planar section 1*b*, on which a barcode or other indicator may be placed. The cover 1 includes a shoulder 1*c* that extends to the bolt 2 when the bolt is in position to secure the cover 1 to a container, as will be described in more detail herein below. The shoulder 1*c* may terminate in an arcuate recess 1*d* complementary to the peripheral shape of the bolt 2.

Figure 2:
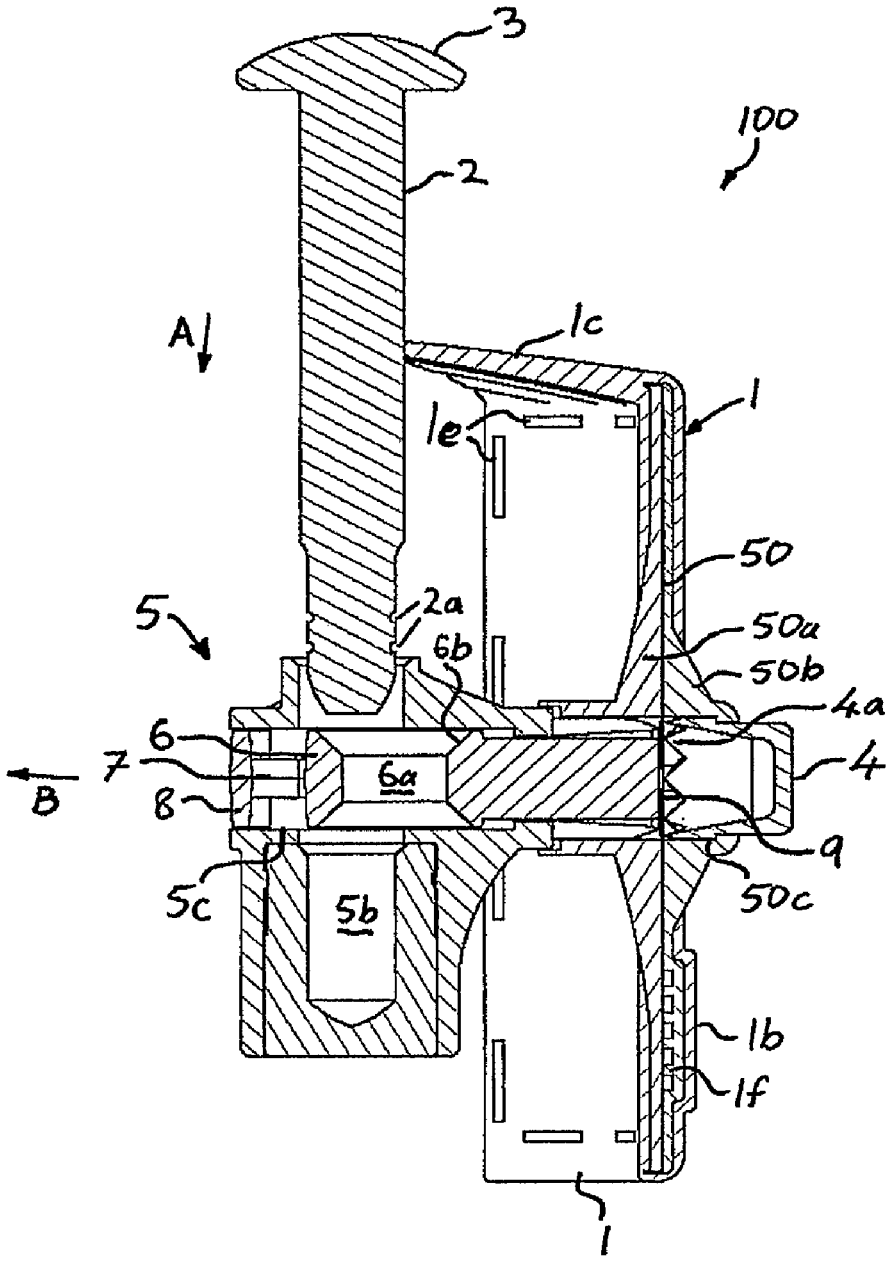
FIG. 2: shows a cross section through line AA of FIG. 1.
Figure 3:
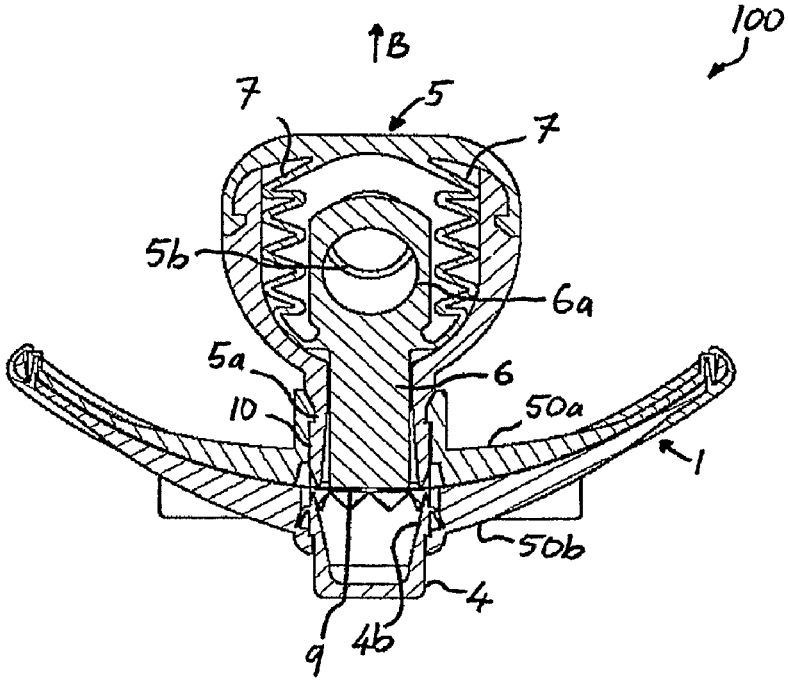
FIG. 3: shows a cross section through line BB of FIG. 1.

A cross-sectional view through the cover 1 and the bolt 2 through line AA of FIG. 1 is shown in FIG. 2 and in FIG. 3 a cross-sectional view through line BB of FIG. 1 is shown.

The cover 1 includes a receptacle for a transponder (not shown in FIGS. 2 and 3), which holds the transponder in place. In the preferred embodiment the transponder receptacle is in the form of a clamp 50 that holds a part of a transponder. The part of the transponder held by the clamp 50 may be one or more antennas. However, other forms of transponder receptacle may be used, or required, depending on the particular shape and configuration of the transponder that is used. The seal 100 may be particularly suited for use with passive transponders and this represents the most preferred embodiment of the invention, although the present invention may also have application to seals having an active transponder.

The clamp 50 includes two parts 50*a* and 50*b*, which are brought together to hold the transponder, which is suitably a radio frequency identification device (RFID), between them. Prior to locating a RFID in the clamp 50, a button 4 is inserted into a central aperture 50*c* of the clamp 50. The rest of the cover 1 is over-moulded about the clamp 50. During the over-moulding process, the clamp 50 may be held by mechanical supports in a known manner, the removal of these mechanical supports creating apertures 1*e* in the cover 1. In order to maintain a uniform thickness of the clamp 50 in the region of the planar section 1*b*, the clamp 50 may have a comb shape 1*f* in this region.

The cover 1 is shaped so that once an RFID has been inserted in the clamp 50 and the rest of the cover 1 moulded about the clamp 50, the RFID can not be removed from the cover 1 without damaging the cover 1. This is one aspect of the seal 100 that contributes to its characteristic of being a tamper evident seal.

FIGS. 2 and 3 further show a cross-section through a sealing mechanism 5. The sealing mechanism 5 in this embodiment is adapted to receive the bolt 2. Accordingly, the seal 100 shown in the accompanying drawings has been adapted to seal a value item that can be locked by the bolt 2, for example by using the bolt 2 to lock the doors of a shipping container closed, in which case the bolt 2 may be inserted through two eyes of the shipping container's doors and then into the sealing mechanism 5. Mechanisms for engaging with and securely holding a bolt are well known and will therefore not be described herein. Variations and/or modifications to the sealing mechanism 5 may be required to seal other value items.

The sealing mechanism 5 is engaged with the clamp 50 of the cover 1 through an interlocking engagement mechanism 5*a* (see FIG. 3). In alternative embodiments where the cover 1 is shaped differently, the sealing mechanism 5 may engage with another part of the cover 1.

The sealing mechanism 5 includes a first shaft 5*b* and a second shaft 5*c*, which extend transverse to each other and intersect one another. The first shaft 5*b* is shaped, dimensioned and oriented to receive the bolt 2 and engage with circumferential rings 2*a* provided on the bolt 2 so as to prevent the bolt 2 from being removed from the shaft 5*b* after it has been inserted.

The second shaft 5*c*, which in the embodiment shown in the accompanying drawings is formed in one part by the clamp 50 and in another part by the sealing mechanism 5, contains a movable member 6, which includes an aperture 6*a* through it and which has a frustoconical shaped opening 6*b* on the side of the aperture 6*a* that receives the bolt 2. In FIG. 2, a similar shaped opening to opening 6*b* is also provided on the opposite side of the aperture 6*a*, but this is not necessary. When the bolt 2 is moved downwards in the direction shown by arrow A, the bolt 2 contacts a side wall of the opening 6*b* and forces the movable member 6 to move in the direction indicated by arrow B. This movement is against the force of a biasing device, referred to herein as a spring 7, which extends between the movable member 6 and a cap 8 and which is fixedly engaged with the sealing mechanism 5. The spring 7 may be any suitable biasing device or material, including a coiled metal or plastic strip and a resilient soft material such as rubber. In addition, the spring 7 may be replaced or used in addition to another biasing device operable to pull the movable member 6 in the opposite direction to arrow B, such device possibly being an elastic material extending between the movable member 4 and the second shaft 5*c*.

A conductive ring 9 is located at the distal end of the movable member 6 from the cap 8. The conductive ring 9 is annular shaped and is dimensioned to extend around a chip on the RFID, thereby shorting out the chip and preventing the RFID from transmitting a signal in response to an interrogation signal. Any suitably shaped conductive body may be used instead of the conductive ring 9, provided that the conductive body effectively renders the RFID inoperable when it is in contact with the RFID.

Before the seal 100 is used to lock a container, the RFID is maintained in an inoperable state due to the conductive ring 9 being pressed against the RFID by the spring 7. The RFID is only transformed into an operable state after the bolt 2 has been inserted into the receptacle 5*b* through the aperture 6*a* of the movable member 6. As can be seen from FIG. 3, the conductive ring 9 is in the plane of the intersecting parts 50*a*, 50*b* of the clamp 50. The spring constant of the spring 7 should be selected to be sufficiently high to maintain the conductive ring 9 in contact with the necessary conductors on the RFID to render the RFID inoperative and sufficiently low so as to not cause damage to the RFID. To further assist in the prevention of damage, the movable member 6 may have an elastic portion along it, to absorb shock applied to the seal 100, for example during transit. This elastic portion may perform the dual function of providing a point of weakening in the movable member 6 as is explained in more detail herein below in relation to FIG. 11.

The seal 100 of the present invention therefore maintains an RFID in an inoperable state until the seal 100 has been applied to a container. This controls when the seal 100 can transmit a signal in response to an interrogation signal.

Figure 4:
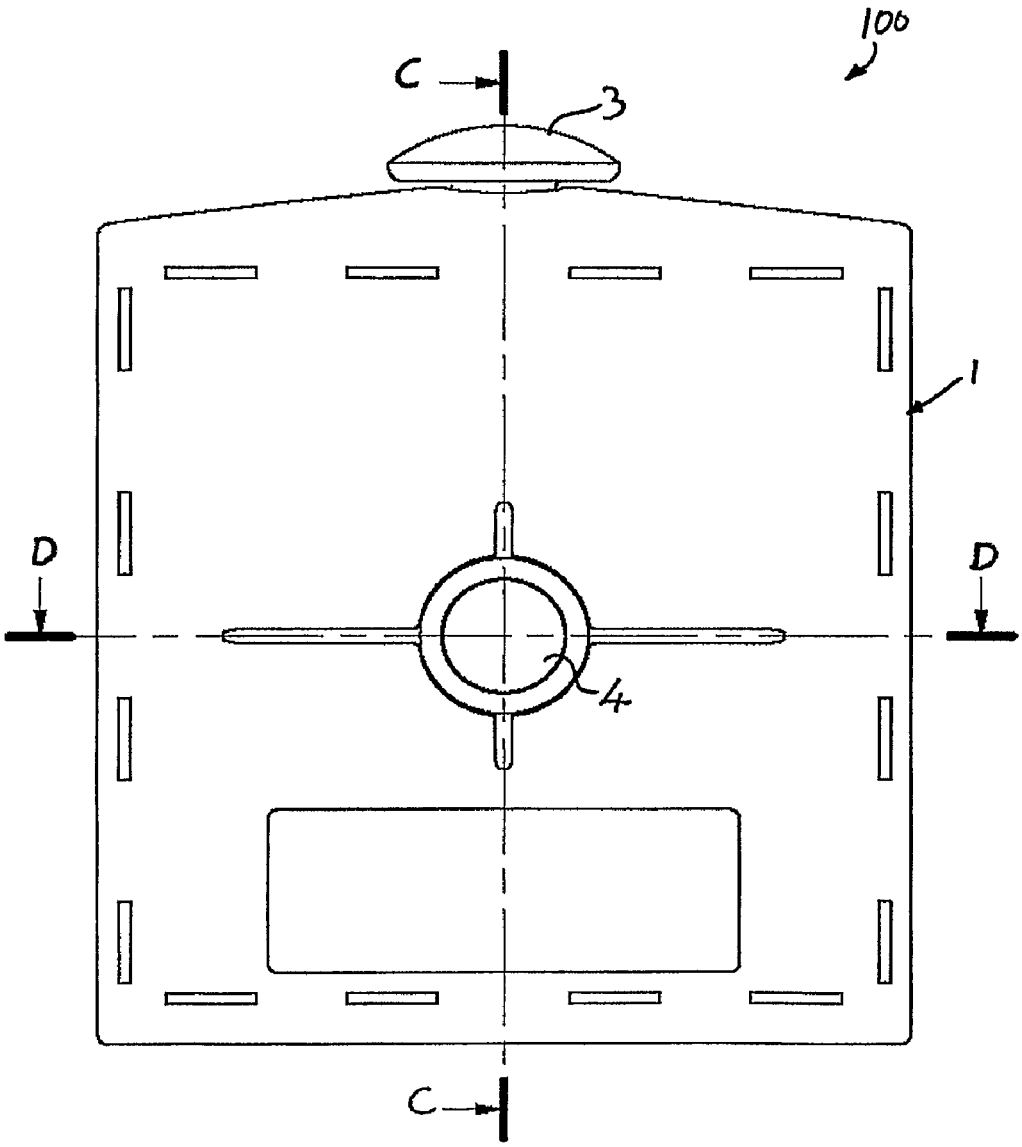
FIG. 4: shows a front elevation of the electronic seal of FIG. 1 in a locked position.
Figure 5:
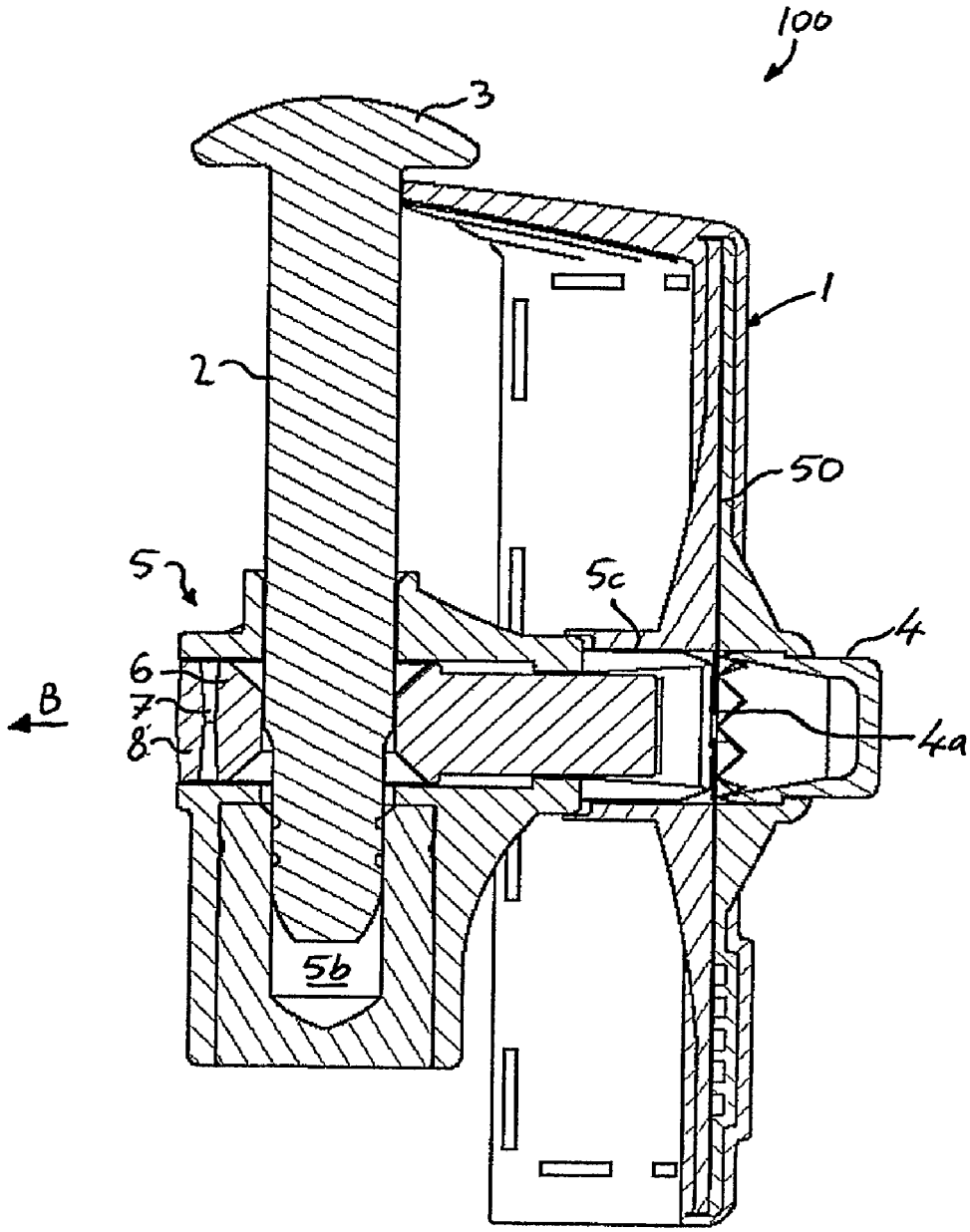
FIG. 5: shows a cross section through line CC of FIG. 4.
Figure 6:
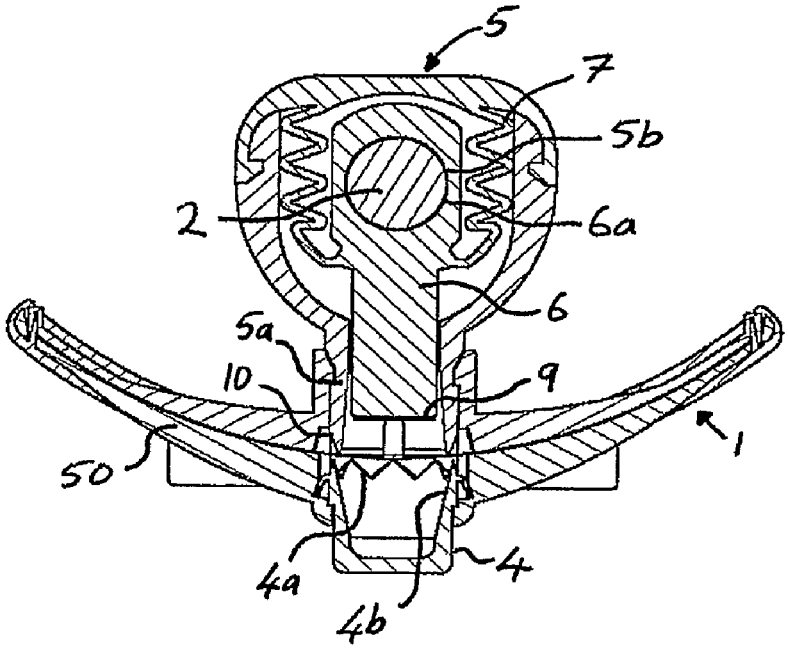
FIG. 6: shows a cross section through line DD of FIG. 4.

FIG. 4 shows a front view of the seal 100 with the bolt 2 inserted into the receptacle 5*b*, FIG. 5 shows a cross-sectional view through line CC of FIG. 4 and FIG. 6 shows a cross-sectional view through line DD of FIG. 4. As can be seen particularly from FIG. 4, when the bolt 2 is inserted into the receptacle 5*b*, the cover 1 extends up to the head of the bolt 2. This prevents access to the bolt 2 to prevent cutting of the bolt without visibly damaging the cover 1. Even if the bolt was able to be cut immediately below the head 3 without damaging the cover, the shaft of the bolt 2 would still extend through the value item and removing the shaft would likely still necessitate damage to at least the shoulder 1*c* of the cover 1.

Inserting the bolt 2 into the receptacle 5*b* through the aperture 6*a* causes the aperture 6*a* to align with the receptacle 5*b* by moving in direction B, against the opposing force of the spring 7. This also moves the ring 9 in direction B, taking it out of the plane occupied by the intersecting parts 50*a*, 50*b* of the clamp 50 and allowing an RFID held by the clamp 50 to operate.

Those skilled in the relevant arts will appreciate that there are alternative methods of maintaining a transponder in an inoperable state and then changing the transponder to an operable state. The methods available for a seal of the present invention may be dictated by the particular transponder that is used. For example, different methods may be available for actuating active transponders between an operative and inoperative state than for passive transponders and transponders having different structures and functionality can be actuated between operable and inoperable states by different methods. The operation of the seal to change the state of the transponder may be mechanical in nature, for example by moving a conductive object, or electronic, for example by changing the state of a chip that implements a simple state machine. Whatever method of actuation is used, the seal of the present invention has the advantage of not having to be constantly in an on state and does not need to be switched to an on state by a separate action that is independent from the normal use of the seal of the present invention to seal a value item.

Figure 7:
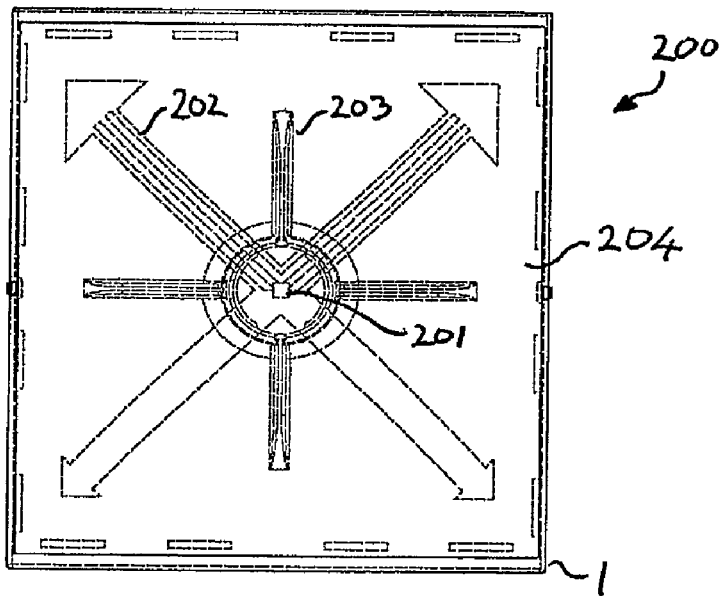
FIG. 7: shows a front view of an RFID according to an aspect of the present invention. The RFID may be suitable for use with the electronic seal of FIG. 1.

FIG. 7 shows a front view of an RFID 200. The RFID 200 includes a chip 201 and an antenna structure 202, which in the shown preferred embodiment is in the shape of a cross. A support structure 203 may provided in the form of plastic ribs on the cover 1. The antenna structure 202 may include two or more separate antennas to assist to increase the effective range and/or effective coverage area of the RFID 200. For example, one antenna structure could be used for each arm or each pair of arms of the cross-shaped antenna structure 202 shown in FIG. 7, so that the antennas within the antenna structure 202 are displaced by 90 degrees relative to each other. The chip 201 and antenna structure 202 are located on a flexible substrate 204. Those skilled in the relevant arts will immediately appreciate how to manufacture an RFID 200 of the type shown in FIG. 7 and therefore the structure and operation of the RFID 200 (or any other transponder that may be used as part of an electronic seal of the present invention) will not be described further herein.

The cover 1 may locate the RFID 200, or at least the antenna structure 202 so as to be spaced apart from the sealing mechanism 5. This spaces the antenna structure 202 away from the bolt 2 and the value item, which may be a metal shipping container. The size of the gap between the RFID 200 (and/or antenna structure 202) and the bolt 2 (and/or the value item) may be selected to obtain improved RFID 200 performance.

Figure 8:
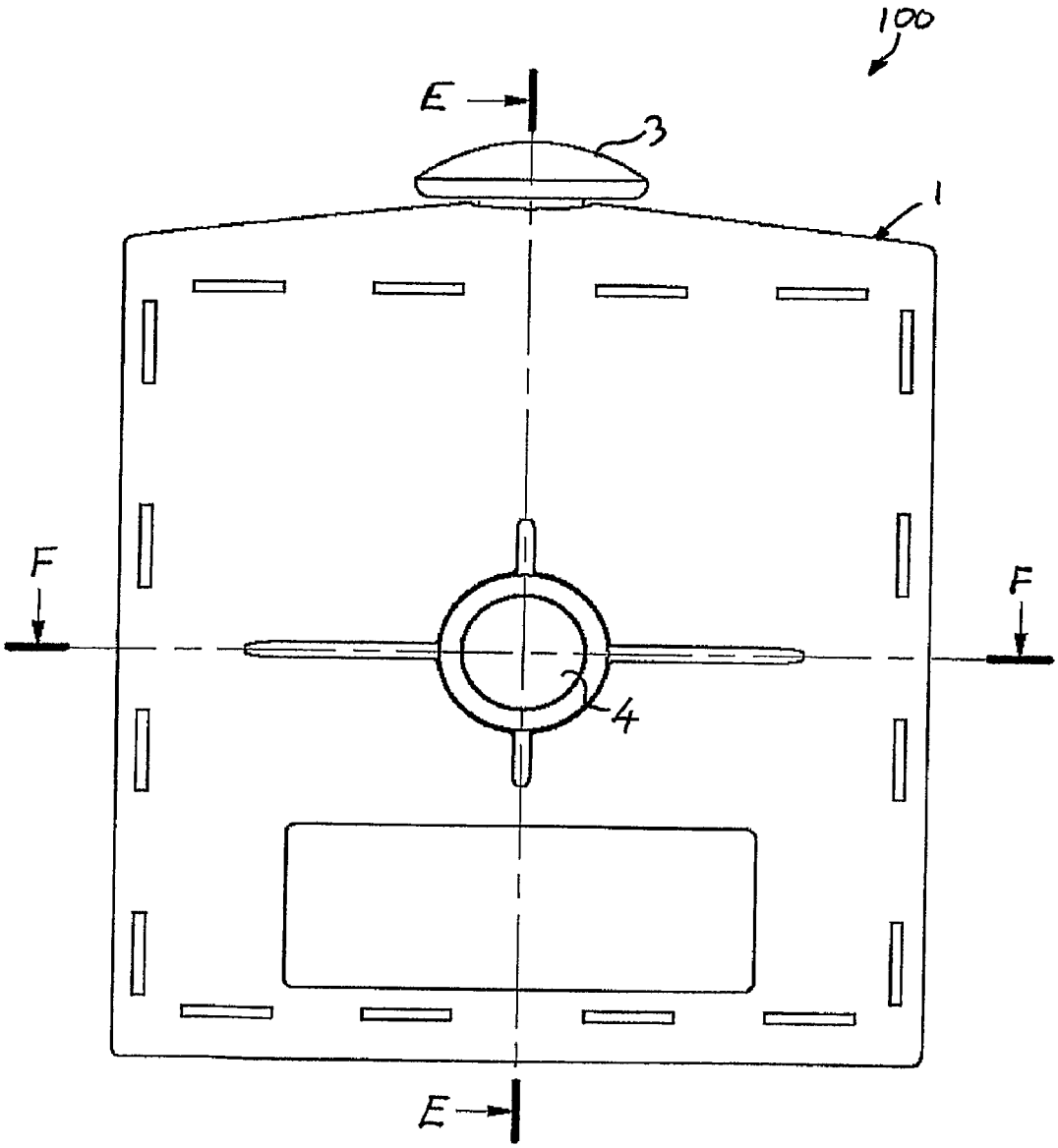
FIG. 8: shows a front elevation of the seal of FIG. 1 during the removal of a cover from the seal.
Figure 9:
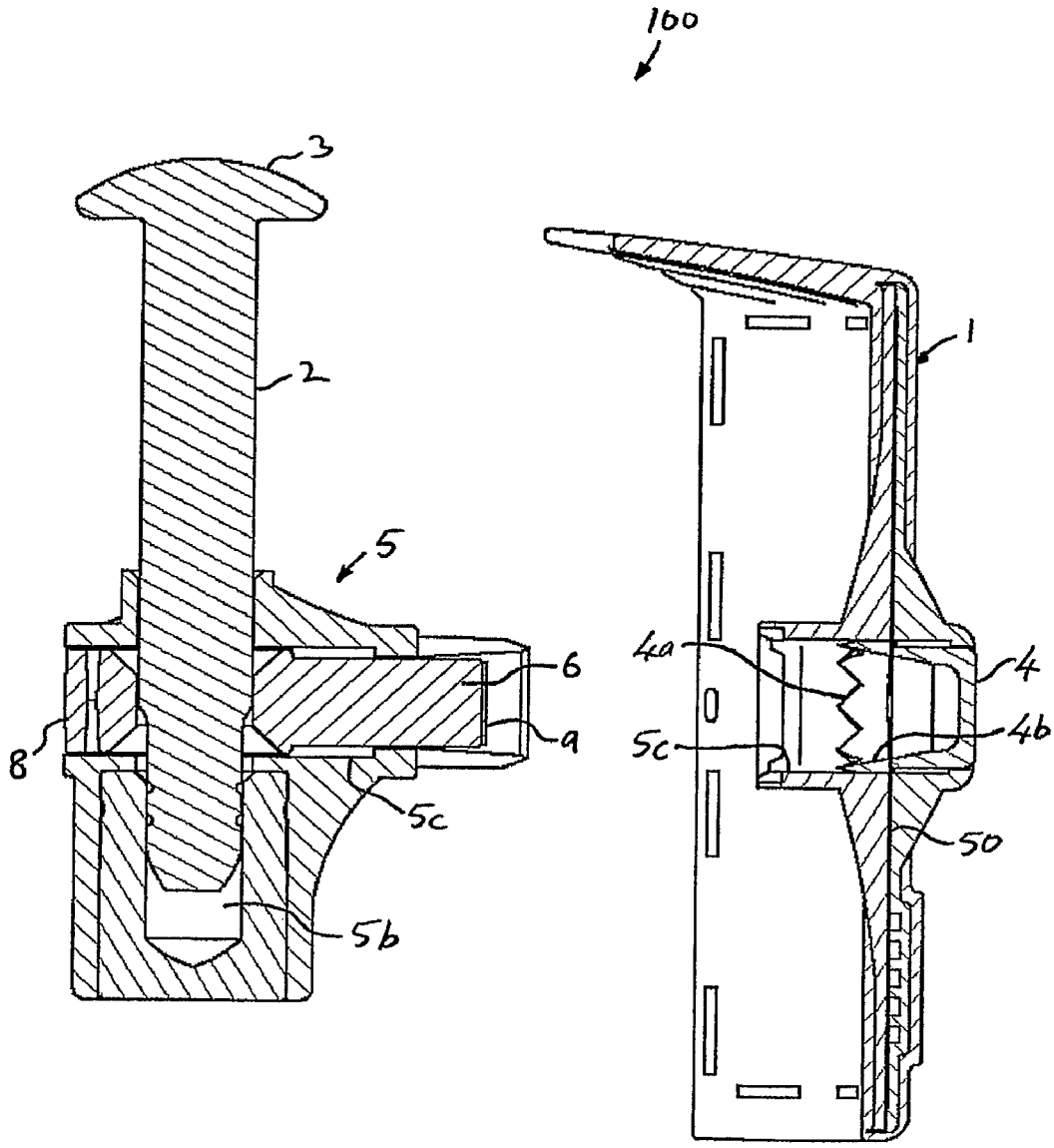
FIG. 9: shows a cross section through line EE of FIG. 8.
Figure 10:
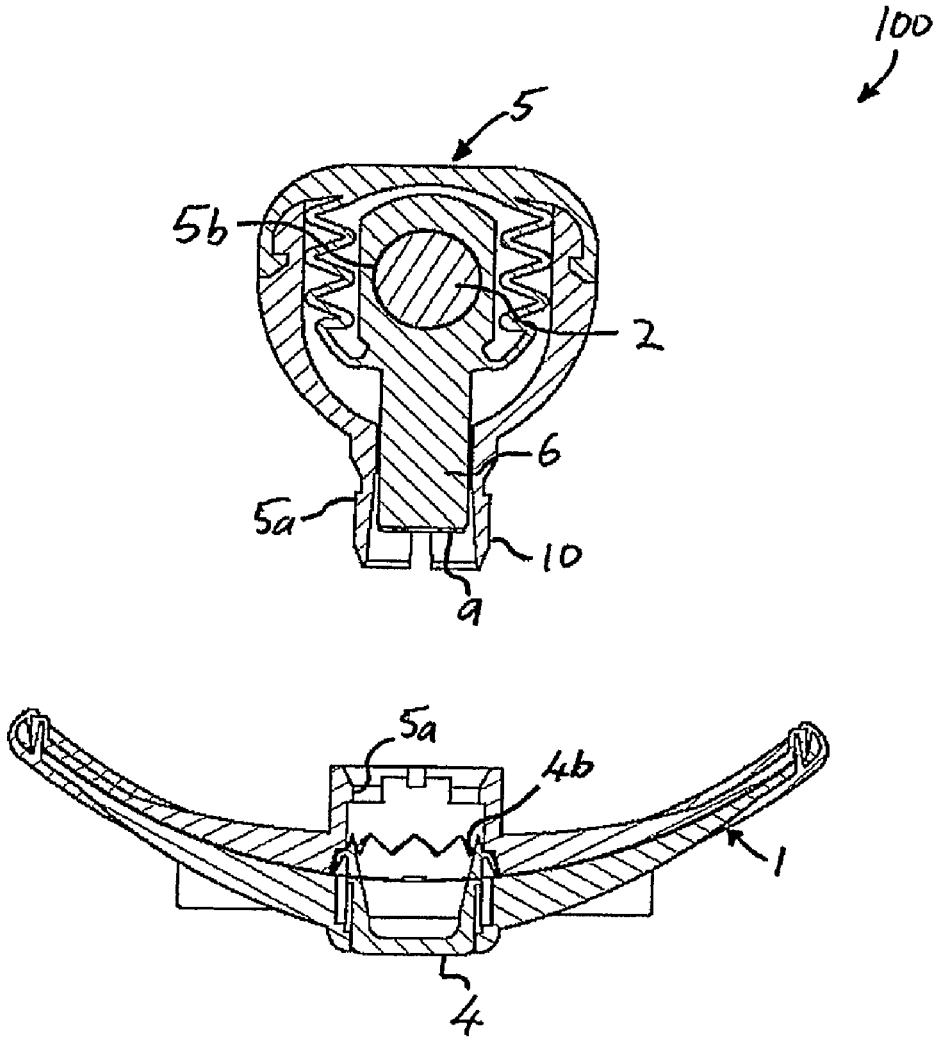
FIG. 10: shows a cross section through line FF of FIG. 8.

To release the seal 100, an operator pushes the button 4 inwards from the position shown in FIGS. 5 and 6 to the position shown in FIGS. 9 and 10. FIGS. 9 and 10 are cross-sectional views through lines EE and FF of FIG. 8 respectively. This causes an edge, in this embodiment a set of teeth 4*a* to move into the shaft 5*c*, thereby severing the chip 201 from the substrate 204, which remains held in place by the clamp 50. This renders the RFID 200 permanently inoperable. Further movement of the button 4 inwards causes the inner surface 4*b* of the button 4 to contact the outer surface 10 of the engagement mechanism 5*a*, which disengages the engagement mechanism 5*a* from the clamp 50. This allows the cover 1 to be removed. The resilient tension provided by the particular engagement mechanism 5*a* shown in the accompanying drawings may be sufficient to push the cover 1 off the sealing mechanism 5 without operator assistance, at least to an extent so that the engagement mechanism 5*a* does not reengage.

The seal 100 shown in the accompanying drawings, having a button 4 for destroying a passive transponder, represents the most preferred embodiment of the present invention. However, alternatives exist and may be used depending on the particular requirements for the seal or the preferences of the designers of a seal of the present invention. By way of example only, the chip 201 may be, or may include an electrically erasable programmable read only memory (EEPROM) and depression of the button 4 may be monitored by a controller for the EEPROM, which may cause the chip 201 to erase itself when the button 4 is depressed. Alternatively, a controller may cause the transponder to emit a different signal, for example a different digital sequence after the button 4 has been depressed.

In another embodiment of the invention, the button 4 may be replaced by a lock cylinder that is actuated by a key. Rotation of the lock cylinder by the key may result in the destruction or modification of the transponder, either mechanically or electronically, or even chemically, for example by releasing a chemical that damages the transponder, or by causing a small exothermic reaction or explosion.

In a still further alternative embodiment, the seal 100 may monitor the integrity of the bolt 2 and/or the cover 1, for example by detecting cutting of the bolt, by detecting a change in the electrical properties of the bolt 2, and/or by running a fine wire about the cover and/or bolt and detecting severance of the fine wire. Upon detection of an event that indicates possible removal or tampering of the seal 100, the seal 100 changes the transponder in a detectable way.

In the preferred embodiment described herein, the cover 1 can not be removed without first depressing the button 4 and depressing the button 4 causes the RFID 200 to be damaged. An advantage of this embodiment is that accidental destruction of the RFID 200 will be rare. In an alternative embodiment the button 4 may be omitted and the cover 1 may be removed without first pressing the button 4 or any other actuator. In this alternative embodiment the action of removing the cover 1 may damage or alter the transponder, for example by tearing away a part of an antenna that was secured to the cover 1 and leaving behind a chip of the transponder, or by monitoring the breaking of an electrical circuit that extends over the boundary between the cover 1 and the rest of the seal 100.

Therefore, the seal 100 is tamper evident, in that either no signal will be received from the RFID 200, or if the entire seal 100 is replaced, an incorrect signal will be received. As the bolt 2 is inaccessible through the cover 1, or at least it is difficult to access and cut the bolt 2 without damaging the cover 1, the seal 100 is readily tamper evident and it is difficult to overcome the tamper evident mechanisms in the seal 100.

Figure 11:
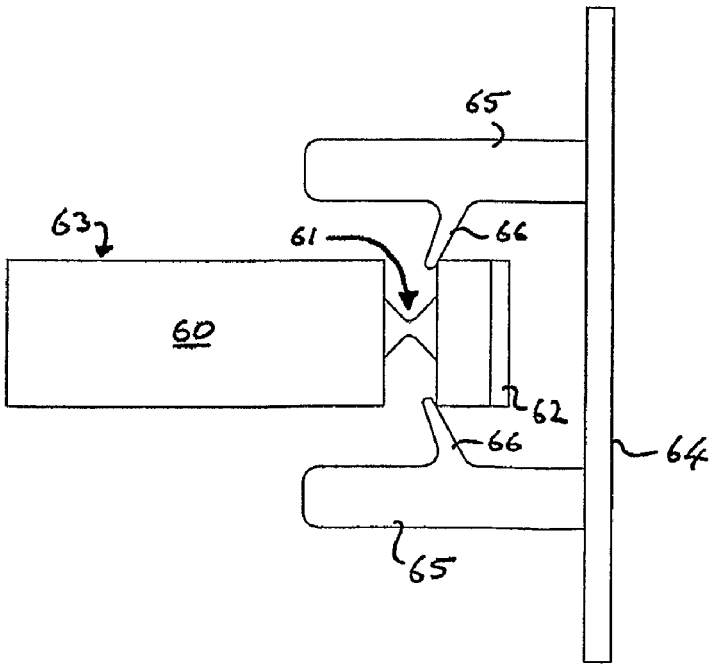
FIG. 11: shows diagrammatically a partial view of an electronic seal according to a second embodiment of the present invention.

FIG. 11 shows a diagrammatic representation of part of an alternative seal according to the present invention. The portions of the seal shown are a movable member 60, similar to the movable member 6 of the seal 100, a cover 65 similar to the cover 1 of the seal 100 and an RFID 64, which may be the RFID 200 shown in FIG. 7. The movable member 60 includes weakened portion 61. The weakened portion 61 is located in the movable member 60 between a conductive ring 62 and an aperture 63 (not visible in FIG. 11) that receives a bolt (not shown). The conductive ring 62 operates in the same way as the conductive ring 9 of the seal 100 to render the RFID 64 inoperable when it is in contact with the RFID 64.

The movable member 60 may be biased against the RFID 64 by any suitable biasing means, including a spring similar to the spring 7. In addition or instead, the movable member 60 is biased against the RFID 64 by two biasing members 66, which are secured to the cover 65. The weakened portion 61 and the biasing members 66 are formed from suitable materials and in an appropriate shape and dimensions so that the resilience of the weakened portion 61 and the biasing members 66 so that weakened portion 61 severs should the cover 65 be removed from the movable member 60 (which is held in place by a bolt). With the weakened portion 61 severed, the biasing members 66 then push the conductive ring 62 against the RFID 64, rendering the RFID 64 inoperable. The cover 65 is shaped so that removal of the conductive ring 62 from the cover 65 can only be achieved by damaging the cover 65.

Those skilled in the relevant arts will appreciate that alternative biasing devices exist, for example a metal spring, that may be used instead of the biasing members 66. Also, where the RFID 64 is an EEPROM or similar device, the seal may monitor for removal of the cover 65 and erase the EEPROM. This may be achieved by monitoring for the breaking of one or more conductors, in which case the weakened portion 61 may be omitted.

The curved shape of the cover 1, as can be best seen in FIGS. 3, 6 and 10, imparts a curvature to the RFID inserted in the clamp 50. The RFID 200 and the clamp 50 are both dimensioned so that when the RFID 200 is positioned within the clamp 50, the chip 201 is centred relative to the ring 9.

As the clamp 50 is curved in shape, this in turn forces a curve in the substrate 204, which results in a curved antenna structure 202. This curvature of the antenna structure 202 results in a transmitted signal covering a segment (formed by the rays extending normal from the antenna structure 202 over the active part of the antenna structure 202. This is in contrast to if the antenna were held flat, when most of the transmitted energy would be directed outwards from the antenna transverse to the plane of the antenna. An advantage of the curved antenna design is that an interrogator could be located towards the side of the cover 1 and still receive a signal at useful distances. This is further enhanced by the dual antenna structure of the RFID 200.

Those skilled in the relevant arts will appreciate that the effective transmit distance for the RFID 200 is reduced in the direction normal to the vertical centre line of the front face 1*a* of the cover 1 when the antenna is curved. However, this reduced effective transmitting distance is viewed by the applicant as being outweighed by the benefit of having a substantially increased effective transmit distance in other directions. For example, when the seal 100 is used on large shipping containers, it is common practice to place two or more containers in close proximity to each other. This may prevent effective access from the front of the seal 100 by an interrogator of the RFID 200. The curved shape of the RFID 200 in the seal 100 allows the RFID 200 to be interrogated at useful distances from other directions, for example by holding a transponder in the gap between two containers.

Those skilled in the relevant arts will also appreciate that by forming a transponder receptacle having a curved shape along two orthogonal axes, for example by forming a parabolic or spherical surface, the effective area of the transponder may be increased along two orthogonal axes, allowing further flexibility in the location of an interrogator for a passive transponder/a receiver for an active transponder. Furthermore, although the preferred embodiment is a curved transponder receptacle, those skilled in the relevant arts will appreciate that other shapes also allow an effective transmission distance over an increased range of angles relative to a transponder having a planar antenna. For example, the transponder receptacle may define three sides of a trapezoid.

In addition, the curved shape of the cover 1 serves a useful treble purpose of increasing the effective angle of transmission, preventing access to the sealing mechanism 5 and orienting the RFID 200 outwards from a surface next to the seal 100, to which the seal 100 may be mounted. Achieving even two of these purposes with a single structure may result in efficiencies in material and manufacturing costs over alternatives. The advantages of the curved shape of the cover 1 may be achieved whether or not the cover 1 is removable from the sealing mechanism 5 by the use of a button or other actuator. If the cover 1 is not removable from the sealing mechanism 5, then they may be integrally formed, in which case an operator must destruct the cover to access the bolt 2 (or other locking member). Lines of weakness may be formed in the seal 100 to facilitate removal of a cover that has been integrally formed with a sealing mechanism.

The formation of a non-planar antenna structure may have application to any other technologies incorporating transponders and this aspect of the present invention should not be understood as limited to use on electronic seals, although the Applicant believes that it has particular utility when applied to electronic seals.

The cover 1 and sealing mechanism 5 may be constructed from a suitably robust moulded plastic material. The receptacle 5*b* may need to be constructed from a metal or metal alloy in order to adequately prevent removal of the bolt 2 after it has been engaged with the receptacle 5*b*. The conductive ring 9 may be aluminium foil and the shaft 6, cap 8 and spring 7 may be polyurethane if they are integrally formed components, or may be separate components, in which case the spring 7 may be a metal spring.

The sealing mechanism 5 of the electronic seal 100 may also have application to other forms of monitoring, either with or without the cover 1. These applications may be realised by replacing the bolt 2 and receptacle 5*b* with a pin that is readily removed from the sealing mechanism 5. The pin may be secured to a value item, which may including a door of a container, so that if the value item is moved from a particular location the pin is pulled out from the sealing mechanism 5, which results in the conductive ring 9 being pushed against the transponder. Removal of the pin can then be detected without visual inspection by the absence of a response by the RFID 200 to an interrogation signal. Similarly, if the spring 7 is reverse biased, the RFID 200 may become active upon removal of the pin. One example application of a sealing mechanism 5 of this type is on aircraft, where the pin may be secured to the door of a container for a lifejacket or secured to the lifejacket itself, so that removal or tampering with a lifejacket can be readily detected without necessarily having to perform a visual inspection.

An advantage of the present invention is the ability to provide an electronic device that activates when tampering is detected. This may allow very quick identification of value items that have been tampered with, as all the transponders that are not indicating a tamper condition are off. Such a tamper evident device may be suited to applications where a person tampering with the value item is unlikely to also successfully tamper with the electronic device so as to render it inoperable. The cover 1 of the present invention, without the button 4, may assist to protect the device so as to prevent damage to the electronic device that prevents it from activating.

It will be understood that the invention disclosed and defined in this specification extends to all alternative combinations of the individual features mentioned or evident from the text or drawings. All of these different combinations constitute various alternative aspects of the invention.

It will also be understood that the term "comprises" (or its grammatical variants) as used in this specification is equivalent to the term "includes" and should not, unless the context clearly requires otherwise, be taken as necessarily excluding the presence of other elements or features.

The invention claimed is:

1. An electronic seal comprising:

a sealing mechanism changeable from an open configuration to a closed configuration by user operation, a transponder receptacle, an electrically conductive object, and an actuator that is actuated when the sealing mechanism changes from the open configuration to the closed configuration, wherein the electronic seal maintains a transponder held in the transponder receptacle in an inoperable state by placing the electrically conductive object in a position to contact the transponder until and only until the actuator is actuated, wherein actuation of the actuator results in movement of the electrically conductive object away from said position.

2. The electronic seal of claim 1, wherein the sealing mechanism comprises a shaft to receive a locking member and wherein said user operation that changes the sealing mechanism from the open configuration to the closed configuration comprises insertion of the locking member in the shaft.

3. The electronic seal of claim 1, wherein the transponder receptacle comprises at least a portion that is shaped and dimensioned to hold at least one part of at least one antenna of the transponder in a curved shape.

4. The electronic seal of claim 3, wherein the curved shape has a convex side facing away from the sealing mechanism and a concave side facing towards the sealing mechanism.

5. The electronic seal of claim 4, wherein the transponder receptacle is formed within a cover for the sealing mechanism.

6. The electronic seal of claim 5, adapted for use to seal a shipping container having at least one door, wherein the sealing mechanism is adapted to seal the at least one door and the cover maintains the transponder in an orientation outwards of the at least one door.

7. The electronic seal of claim 5, wherein the cover and the sealing mechanism are engaged by a frangible link and wherein breakage of the frangible link causes the transponder to become inoperable.

8. A housing for a transponder having a flexible antenna structure, the housing including a transponder receptacle that extends into three planes so as to enable the transponder located in the transponder receptacle to transmit a signal over a wider range of angles than if the transponder receptacle were planar.

9. The housing for a transponder of claim 8 when forming part of an electronic seal comprising a sealing mechanism, and a cover one of formed integrally with and secured to the sealing mechanism, wherein the cover inhibits access to the sealing mechanism without first either removing the cover from the sealing mechanism or damaging at least one of the cover and the transponder held in the receptacle.

10. The housing for a transponder of claim 9, wherein the cover is removably engaged with the sealing mechanism by an engagement mechanism and wherein release of the engagement mechanism causes the transponder held in the transponder receptacle to be damaged.

11. The housing for a transponder of claim 9, wherein the housing is attachable to a separate object and is shaped and dimensioned to maintain the transponder in a required orientation after it has been attached to the object.

12. The housing for a transponder of claim 9, wherein the cover is removably engaged with the sealing mechanism by an engagement mechanism and wherein release of the engagement mechanism causes the transponder held in the transponder receptacle to be detectably modified.

13. The housing for a transponder of claim 8, wherein the transponder receptacle has a non-linear profile along a first axis and a substantially linear profile along a second axis that is transverse to the first axis.

14. The housing for a transponder of claim 13, wherein the non-linear profile is a curve.

15. The housing for a transponder of claim 8, wherein the transponder receptacle has a non-linear profile along two orthogonal axes.

16. The housing for a transponder of claim 15, wherein the non-linear profile is a curve.

17. The housing for a transponder of claim 8 including the transponder in the transponder receptacle.

18. The housing for a transponder of claim 17 included as part of an electronic seal, wherein the electronic seal is constructed so that removal of the transponder from the transponder receptacle is prevented without visibly damaging the seal.

19. The housing for a transponder of claim 18, wherein at least part of the seal is formed by a material that is moulded about the transponder.

20. An electronic seal comprising:

a) a sealing mechanism changeable from an open configuration to a closed configuration by user operation;

b) a removable cover for the sealing mechanism, the removable cover having therein a transponder receptacle and being one of formed integrally with and secured to the sealing mechanism; and c) an actuator that is actuated when the sealing mechanism changes from the open configuration to the closed configuration, wherein the electronic seal maintains a transponder held in the transponder receptacle in an inoperable state until and only until the actuator is actuated, and wherein the transponder receptacle is adapted to cause the transponder to have a shape that extends into three planes, and wherein removal of the removable cover causes the transponder to be detectably modified.

21. The electronic seal of claim 20, wherein removal of the removable cover involves actuating a further actuator and wherein the actuation of the further actuator causes the transponder held in the transponder receptacle to be detectably modified.

22. The electronic seal of claim 21 including the transponder in the transponder receptacle, the removable cover formed so that removal of the transponder from the transponder receptacle is prevented without damaging the cover.

23. The electronic seal of claim 20, wherein removal of the removable cover involves actuating a further actuator and wherein the actuation of the further actuator causes the transponder held in the transponder receptacle to be damaged.

24. A method of manufacturing an electronic seal, the method comprising providing a seal mechanism that engages with an object to seal the object and forming a cover for the seal mechanism, the cover for the seal mechanism moulded about a transponder to enclose the transponder, the cover formed in a shape so that disengagement of the seal mechanism from the object can only be achieved by detectably modifying the transponder.

25. The method of claim 24, wherein the transponder is a passive transponder and the cover is formed in a shape so that disengagement of the seal from the object can only be achieved by damaging an antenna of the transponder.

26. The method of claim 24 including forming the seal mechanism and cover as separate removably engageable components and forming an actuator, wherein actuation of the actuator both allows disengagement of the seal mechanism and cover after they have been engaged and causes the transponder to be detectably modified.

27. The method of claim 24, wherein the cover is formed in a shape so that disengagement of the seal mechanism from the object can only be achieved by damaging the transponder.

28. An electronic device for monitoring a value item, the electronic device comprising a transponder and an actuator for the transponder that is actuated upon tampering with the value item, wherein the electronic device maintains the transponder in an inoperable state until and only until the actuator is actuated, wherein the electronic device further comprises a transponder receptacle comprising at least a portion that is shaped and dimensioned to hold at least one part of at least one antenna of the transponder in a curved shape.

29. The electronic device of claim 28, wherein the actuator comprises a shaft to receive a locking member and wherein one of removal and insertion of the locking member in the shaft causes the actuator to actuate.

30. The electronic device of claim 28, including an electrically conductive object and wherein actuation of the actuator results in movement of the electrically conductive object into or out of contact with the transponder to place the transponder in an inoperable and operable state respectively.

31. An electronic seal for a shipping container, the electronic seal comprising a sealing mechanism that seals the shipping container through the use of a locking member, a cover for the sealing mechanism that is one of formed integrally with and secured to the sealing mechanism and a transponder receptacle that is located spaced apart from the locking member when the locking member is used with the sealing mechanism, wherein the transponder receptacle is adapted to cause a transponder located in the receptacle to have a shape that extends into three planes.

32. The electronic seal of claim 31, wherein the cover forms a partial enclosure of the sealing mechanism.

33. The electronic seal of claim 32, wherein the transponder receptacle is formed within said cover.

34. A transponder device comprising a transponder and an actuator that when actuated moves a conductive object to a predetermined position, wherein when the conductive object is in the predetermined position the transponder is maintained in an inoperable state and changes to an operable state when the conductive object is moved from the predetermined position, wherein the transponder is housed within a cover and the actuator adapted to be moved when the cover is engaged with a structure in a predetermined manner.

35. A method of forming a transponder device comprising a control chip and an antenna, the method comprising forming the antenna on a flexible substrate as a planar antenna structure and forming a housing for the transponder device, the housing shaping the antenna structure into a non-planar shape.

36. The method of claim 35 further comprising forming the housing so as to be secured to or securable to an object and forming the housing in a shape that is adapted to hold the transponder in a fixed orientation relative to said object.

* * * * *